US006838811B2

(12) United States Patent
Tagami et al.

(10) Patent No.: US 6,838,811 B2
(45) Date of Patent: Jan. 4, 2005

(54) DEFLECTION YOKE AND CRT DEVICE

(75) Inventors: Etsuji Tagami, Takatsuki (JP); Katsuyo Iwasaki, Nishinomiya (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 61 days.

(21) Appl. No.: 10/448,706

(22) Filed: May 30, 2003

(65) Prior Publication Data

US 2004/0032197 A1 Feb. 19, 2004

(30) Foreign Application Priority Data

Jun. 7, 2002 (JP) ..... 2002-167269
Jun. 14, 2002 (JP) ..... 2002-173755

(51) Int. Cl.[7] ..... H01J 29/70
(52) U.S. Cl. ..... 313/440; 313/439
(58) Field of Search ..... 313/421, 426, 313/432, 433, 439, 440

(56) References Cited

FOREIGN PATENT DOCUMENTS

| | | |
|---|---|---|
| JP | 61-56757 | 9/1984 |
| JP | 7-35289 | 3/1986 |

*Primary Examiner*—Vip Patel

(57) ABSTRACT

The invention provides a deflection yoke comprising: a funnel-shaped core (ii) being made of a magnetic material, (iii) having, on its inner wall, ridges each of which starts from the narrower end and extends toward the wider end for a part of the length of the core, the ridges being arranged circumferentially at intervals and thereby forming core slots, and (iv) in which the remaining inner wall near the wider end is smooth; a first deflection coil wound as partially guided by the core slots; second deflection coil positioned more inward than the first deflection coil; and an insulating frame that (i) is sandwiched between the first and second deflection coils, and (ii) has, in an area corresponding to the core's smooth area, guiding slots extending along the CRT axis direction and being arranged circumferentially, wherein the second deflection coil is wound as partially guided by the guiding slots.

9 Claims, 13 Drawing Sheets

DEFLECTION YOKE AND CRT DEVICE

This application is based on the applications Nos. 2002-167269, 2002-173755 filed in Japan, the contents of which are hereby incorporated by reference.

BACKGROUND OF THE INVENTION

1. Field of the Invention

The present invention relates to CRT (Cathode Ray Tube) devices used for TVs and computer displays, and deflection yokes used in such CRT devices, particularly to the structures of the deflection yokes.

2. Description of the Related Art

There is a type of deflection yoke that comprises what is called a slot core. A slot core denotes a type of a funnel-shaped ferrite core that has, on the inner wall thereof, a plurality of slots each of which extends from the narrower end to the wider end, the plurality of slots being arranged circumferentially. A vertical deflection coil and a horizontal deflection coil are wound so as to be guided by the slots of the ferrite core.

A deflection yoke with such an arrangement has the following advantageous effects over a deflection yoke including a ferrite core that is simply funnel-shaped and has a smooth inner wall: The deflection sensitivity is improved because it is possible to position the ferrite core closer to the cathode ray tube. Also, it is possible to reduce eddy-current loss and inhibit heat generation of the deflection yoke because the magnetic flux is less likely to have a flux linkage with the deflection coils.

One of the problematic issues concerning a deflection yoke to which a slot core is applied is how to provide insulation between the vertical deflection coil and the horizontal deflection coil while maintaining the productivity in the manufacturing of deflection yokes. To be more specific, in a case of a ferrite core that is simply funnel-shaped, the vertical deflection coil and the horizontal deflection coil disposed inside can be insulated by inserting, between those coils, an insulating frame that is simply funnel-shaped likewise. On the other hand, in a case of a slot core, since the vertical deflection coil and the horizontal deflection coil are wound so as to be disposed in each of the slots, insulation cannot be provided so simply as that.

One of the examples that have solved the aforementioned problem is a deflection yoke disclosed in the Japanese Unexamined Patent Application Publication No. 11-7891. In this deflection yoke, a funnel-shaped insulating frame as a whole is formed with ridges and slots to fit the ridges and slots in the slot core. Then, after winding a vertical deflection coil directly into the slots of the slot core, the aforementioned insulating frame gets fitted into the slots of the slot core. Subsequently, a horizontal deflection coil gets wound into the slots on the inner wall of the insulating frame. According to this arrangement, there is no loss in the productivity because the insulation between the deflection coils is made by a very simple operation of fitting, onto a slot core, an insulating frame that is shaped to fit the slots of the slot core, after a vertical deflection coil is wound.

Another problematic issue concerning a deflection yoke to which a slot core is applied is how to obtain a deflection magnetic field distribution as desired. This issue arises from circumstances as follows: In a case of a slot core, since the deflection coils are wound along the slots as mentioned above, the winding pattern of a deflection coil which determines the deflection magnetic field distribution is restricted by the ridges and slots (the slot pattern) of the slot core. This is because a slot core (a ferrite core) has a little flexibility in formation of a slot pattern due to its manufacturing process. The deflection yoke disclosed in the aforementioned Japanese Unexamined Patent Application Publication No. 11-7891 has a little flexibility because the winding pattern of not only the vertical deflection coil that is wound directly on the slot core, but also of the horizontal deflection coil, as a result, is restricted by the slot pattern of the slot cores.

In order to cope with this second problematic issue, a deflection yoke is disclosed in the Japanese Examined Utility Model Application Publication No. 7-35289, for example. A funnel-shaped ferrite core used in this deflection yoke has slots formed only in the area of the narrower half, and the inner wall of the wider half is smooth without ridges or slots, so that the flexibility of winding pattern can be achieved in the wider half; however, the Japanese Examined Utility Model Application Publication No. 7-35289 fails to disclose an insulating means between the deflection coils, let alone specific guiding means for the deflection coils.

SUMMARY OF THE INVENTION

A first object of the present invention is to provide a deflection yoke in which the insulation between the horizontal deflection coil and the vertical deflection coil is ensured and that has more flexibility in the winding pattern.

A second object of the present invention is to provide a CRT device comprising such a deflection yoke.

It is possible to achieve the first object of the present invention with a deflection yoke provided on an external surface of a cathode ray tube, comprising: a tube-shaped core (i) in which an opening at a first end is smaller than an opening at a second end, (ii) that is made of a magnetic material, (iii) that has, on an inner wall thereof, a plurality of ridges each of which starts from the first end and extends toward the second end for a part of a length of the core, the plurality of ridges being arranged circumferentially at predetermined intervals and thereby forming a plurality of core slots, and (iv) in which a remaining area of the inner wall thereof in a vicinity of the second end is finished to be smooth; a first deflection coil that is wound on the core so as to be partially guided by one or more of the core slots; a second deflection coil that is positioned more inward than the first deflection coil; and an insulating frame that (i) is sandwiched between the first deflection coil and the second deflection coil, and (ii) has, in an area thereof that corresponds to the smoothly-finished remaining area of the core and/or in an area thereof that extends off the second end of the core in a tube axis direction, a plurality of guiding slots extending along the tube axis direction of the cathode ray tube and being arranged circumferentially, wherein the second deflection coil is wound so as to be partially guided by one or more of the guiding slots.

It is possible to achieve the second object of the present invention with a cathode ray tube device including a cathode ray tube and a deflection yoke provided on an external surface of the cathode ray tube, the deflection yoke comprising: a tube-shaped core (i) in which an opening at a first end is smaller than an opening at a second end, (ii) that is made of a magnetic material, (iii) that has, on an inner wall thereof, a plurality of ridges each of which starts from the first end and extends toward the second end for a part of a length of the core, the plurality of ridges being arranged circumferentially at predetermined intervals and thereby forming a plurality of core slots, and (iv) in which a remaining area of the inner wall thereof in a vicinity of the second end is finished to be smooth; a first deflection coil that is wound on the core so as to be partially guided by one or more of the core slots; a second deflection coil that is positioned more inward than the first deflection coil; and an insulating frame that (i) is sandwiched between the first deflection coil and the second deflection coil, and (ii) has, in an area thereof that corresponds to the smoothly-finished remaining area of the core and/or in an area thereof that extends off the second end of the core in a tube axis direction, a plurality of guiding slots being arranged circumferentially at intervals that are different from the intervals at which the core slots are arranged, wherein the second deflection coil is wound so as to be partially guided by one or more of the guiding slots.

It is also possible to achieve the second object of the present invention with a cathode ray tube device including a cathode ray tube and a deflection yoke provided on an external surface of the cathode ray tube, the deflection yoke comprising: a tube-shaped core (i) in which an opening at a first end is smaller than an opening at a second end, (ii) that is made of a magnetic material, (iii) that has, on an inner wall thereof, a plurality of ridges each of which starts from the first end and extends toward the second end for a part of a length of the core, the plurality of ridges being arranged circumferentially at predetermined intervals and thereby forming a plurality of core slots, and (iv) in which a remaining area of the inner wall thereof in a vicinity of the second end is finished to be smooth; a first deflection coil that is wound on the core so as to be partially guided by one or more of the core slots; a second deflection coil that is positioned more inward than the first deflection coil, and is wound so that part of its length is disposed in one or more of the core slots; and an insulating frame that (i) is sandwiched between the first deflection coil and the second deflection coil, and (ii) has, in an area thereof that corresponds to the smoothly-finished remaining area of the core and/or in an area thereof that extends off the second end of the core in a tube axis direction, a plurality of guiding slots extending along a central axis direction of the core and being arranged circumferentially, wherein the guiding slots are provided being a predetermined distance apart, in the central axis direction, from the core slots, and the second deflection coil is wound so as to be partially guided by one or more of the guiding slots.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes embodiments of the present invention, with reference to the drawings.

First Embodiment

Figure 1:
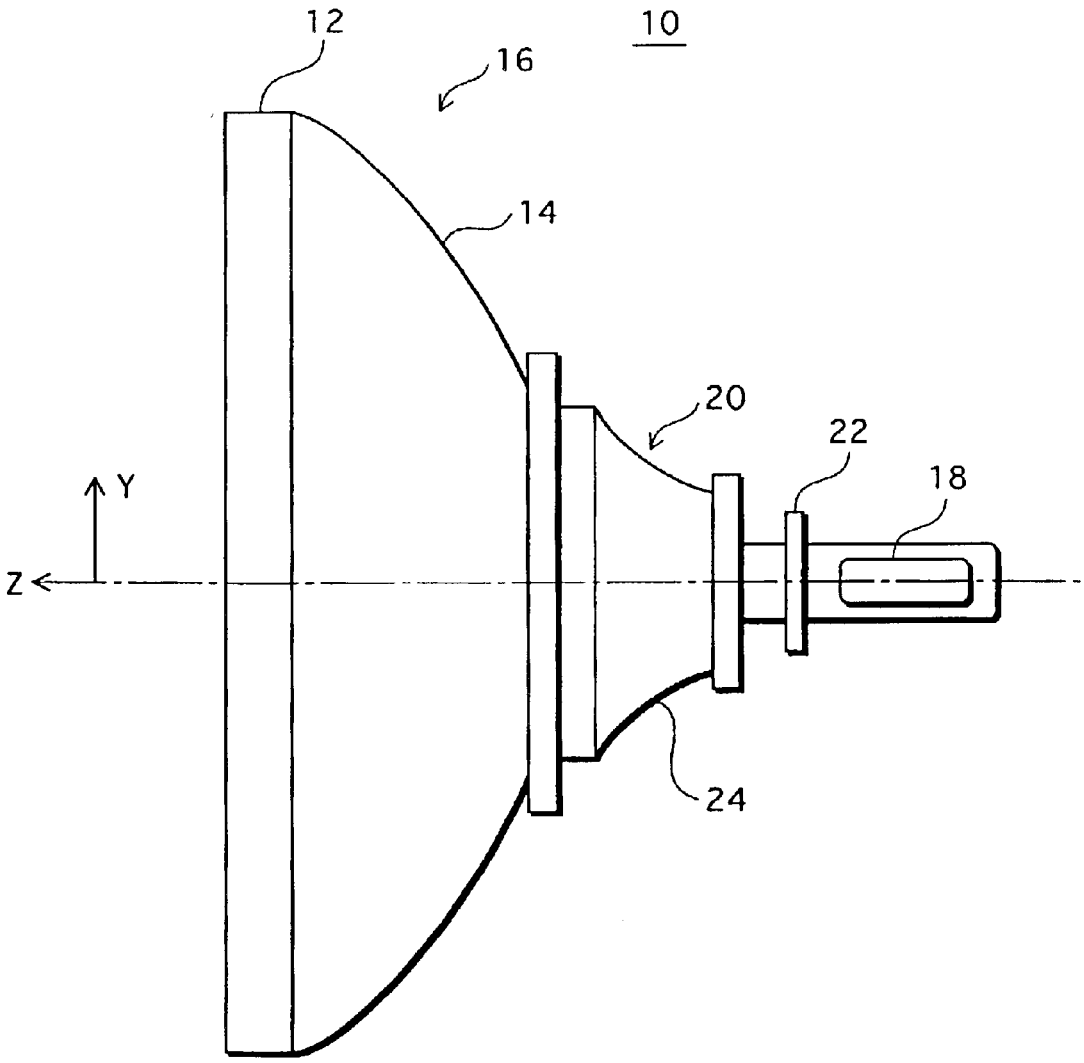
FIG. 1 is a side view to illustrate the general structure of the CRT device.

FIG. 1 is a schematic side view of a color CRT device 10 of an embodiment. The color CRT device 10 comprises: an evacuated envelope 16 in which (a) a front flat panel 12 whose inner surface has a phosphor screen formed thereon and (b) a funnel 14 are joined together; an electron gun 18 disposed in the neck of the funnel 14; a deflection yoke 20 disposed on the external surface of the funnel 14; and a convergence yoke 22. FIG. 1 merely shows the positional relationship among the aforementioned members, and the members such as the deflection yoke 20 are illustrated in very simplified forms.

Figure 2:
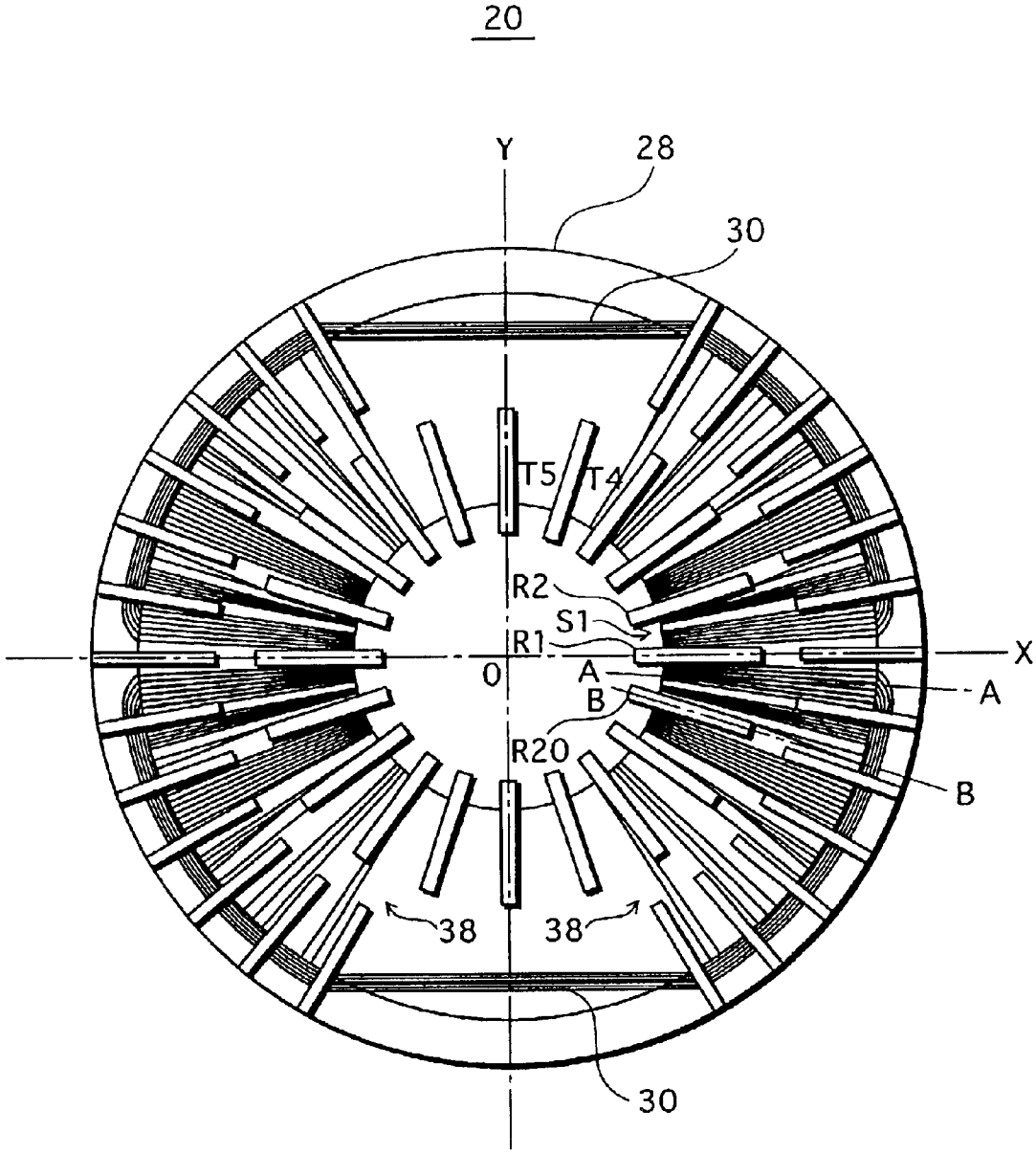
FIG. 2 is a front view to illustrate the general structure of the deflection yoke.

FIG. 2 is a front view of the deflection yoke 20 being viewed from the phosphor screen side. In the present application, X denotes a horizontal axis, and Y denotes a vertical axis. Further, an axis that perpendicularly intersects both the X axis and the Y axis at the origin (the zero point) at which the X axis intersects the Y axis will be referred to as the Z axis (the tube axis).

Figure 3:
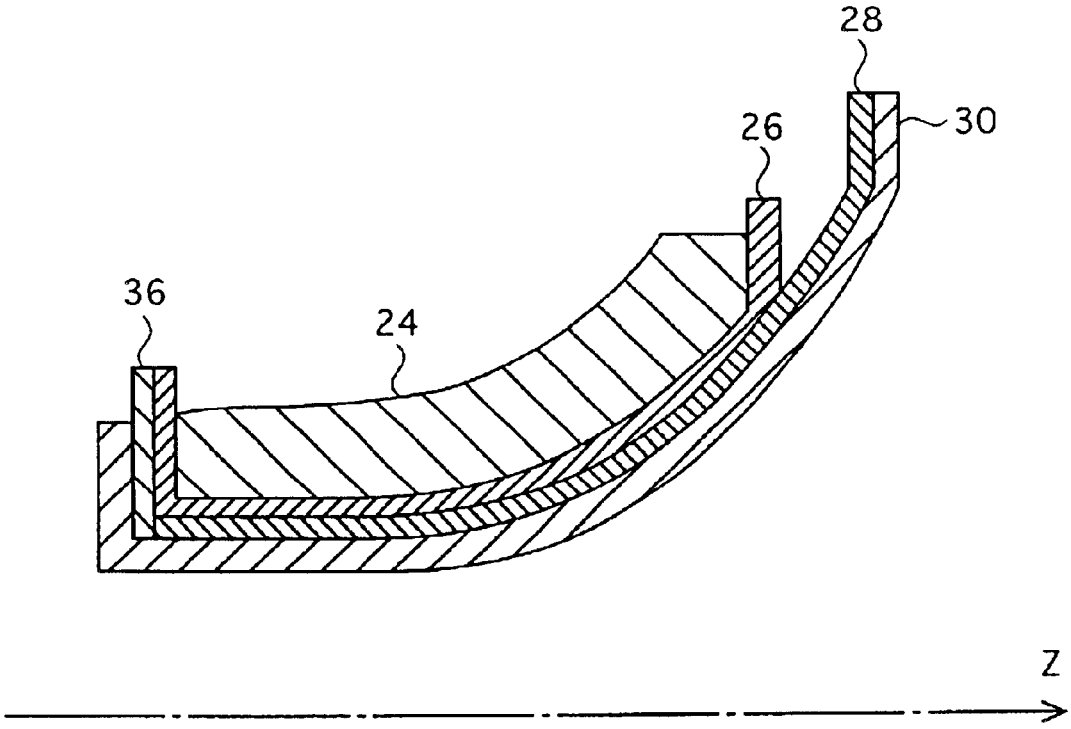
FIG. 3 is the A—A cross section of FIG. 2.
Figure 4:
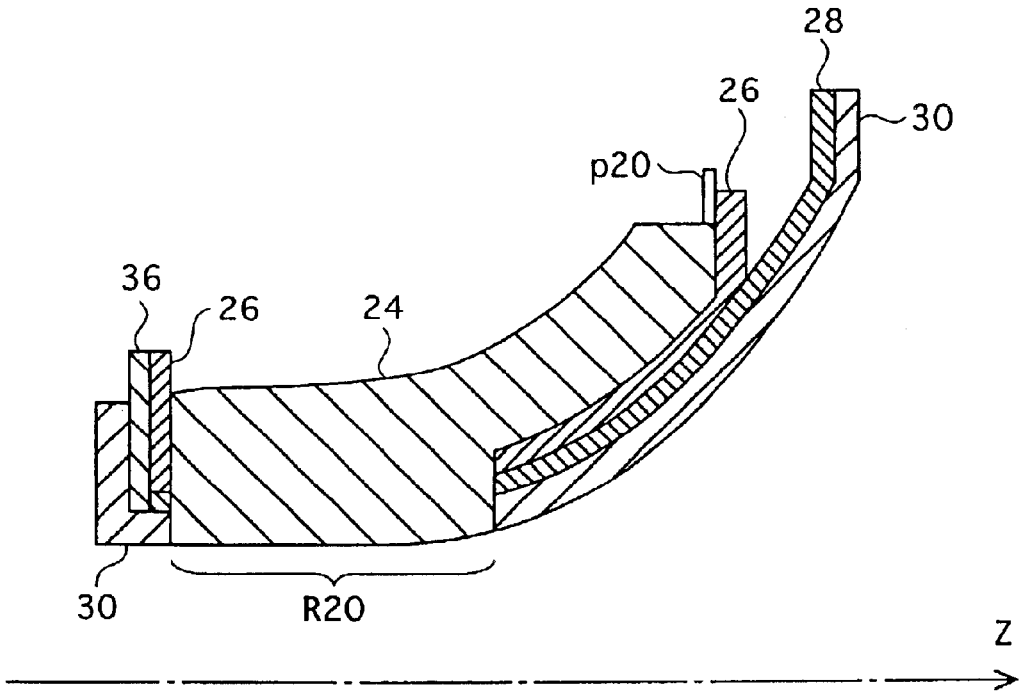
FIG. 4 is the B—B cross section of FIG. 2.

Additionally, FIG. 3 is the A—A cross section of FIG. 2. FIG. 4 is the B—B cross section of FIG. 2.

As shown in FIGS. 2, 3, and 4, the deflection yoke 20 is made of a magnetic material and includes a core 24 which as a whole is substantially tube-shaped. Inside the core 24, a vertical deflection coil 26, an insulating frame 28, and a horizontal deflection coil 30 are disposed in the stated order. Ferrite is used as a magnetic material in the present embodiment. Hereafter, the core 24 will be referred to as a ferrite core 24.

As shown in FIG. 1, the ferrite core 24 is funnel-shaped, more specifically, the diameter at the end on the phosphor screen (the front flat panel 12) side is larger than the diameter at the other end on the electron gun 18 side. In other words, the ferrite core 24 is substantially tube-shaped and whose diameter gets larger beginning from the electron gun 18 side thereof (the narrower end) toward the phosphor screen side thereof (the wider end).

Figure 5:
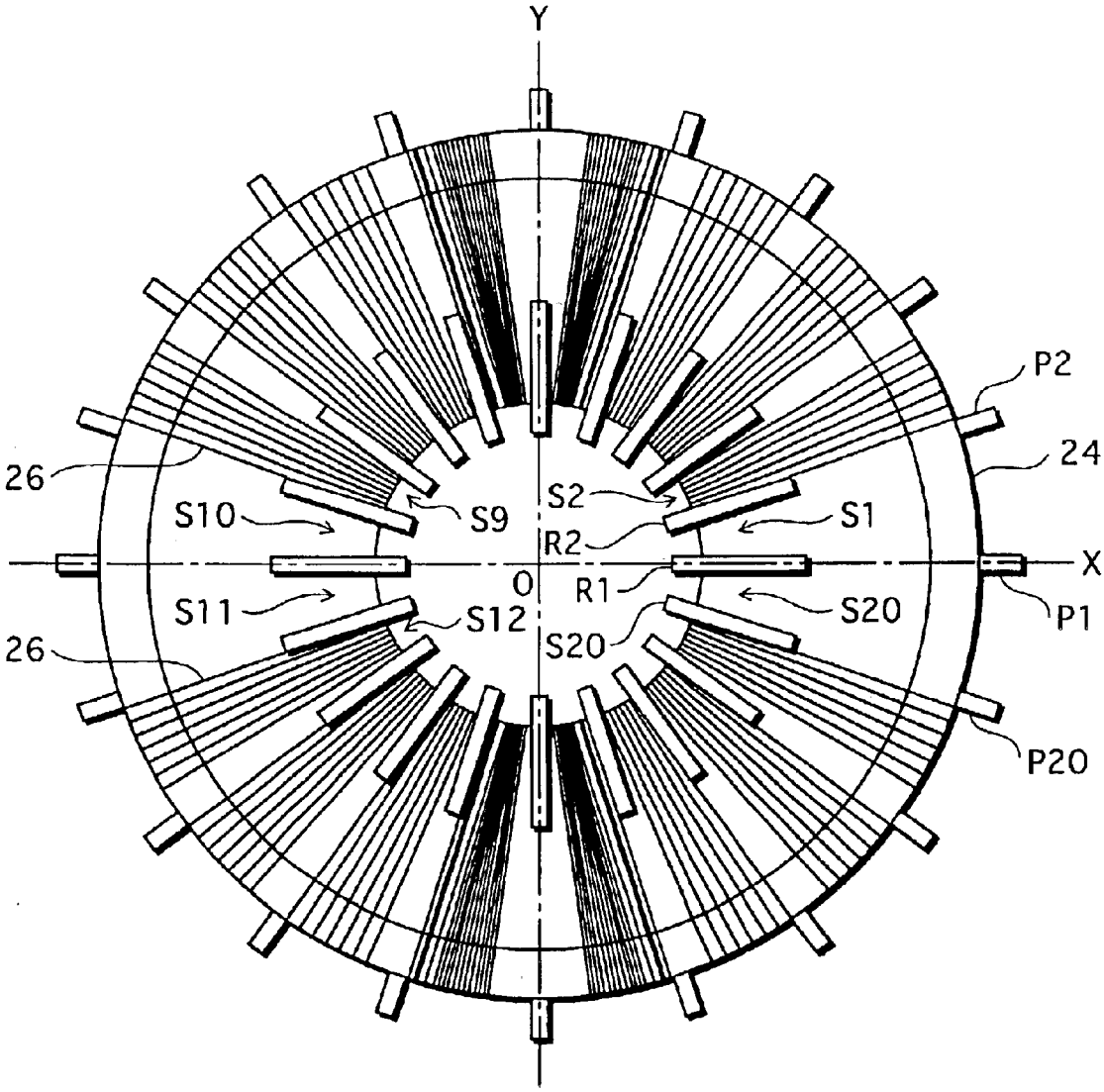
FIG. 5 is a front view of the ferrite core on which a vertical deflection coil is wound.

FIG. 5 is a front view of the ferrite core 24 on which the vertical deflection coil 26 is wound.

Formed on the inner wall of the ferrite core 24 are a plurality of ridges "Rs" (hereafter referred to as core ridges) each of which extends along the Z axis (the tube axis) direction so as to protrude toward the Z axis, the plurality of core ridges being arranged circumferentially at regular intervals. In the present example, twenty core ridges are formed at 18-degree intervals. As shown in FIGS. 4 and 5, each of the core ridges Rs extends substantially halfway from the narrower end (the end on the electron gun side) to the larger end (the end on the phosphor screen side). As shown in FIG. 5, viewing the ferrite core 24 from the front (from the phosphor screen side) helps you understand that the core ridges Rs are provided in a radial pattern. As for the core ridges Rs on the X axis, the core ridge that is on the right side as we face FIG. 5 will be referred to as R1, and serial numbers will be given counterclockwise starting from R1, in order to identify each of the core ridges as R1 to R20.

As a result of the core ridges Rs being formed, a slot (hereafter referred to as a core slot) "S" is formed between the ridges positioned adjacent to each other. The core slot formed by the core ridge R1 and the core ridge R2 will be referred to as the core slot S1, and serial numbers will be given counterclockwise starting from S1, in order to identify each of the core slots as S1 to S20.

The remainder of the inner wall of the ferrite core 24 in the Z axis (tube axis) direction where no core ridges Rs are formed (i.e. where no core slots Ss are formed) is finished to be smooth.

Hereafter, of the inner wall of the ferrite core 24, the area in which core slots Ss are formed will be referred to as a core slot area, and the area that is finished to be smooth will be referred to as a smooth area.

Further, projections "Ps" are provided on the external surface of the ferrite core 24 at the vicinity of the wider end at such positions to which the lines extended from the core ridges R1 to R20 correspond respectively. The projections Ps are pins made of synthetic resin that are adhered to the external surface of the ferrite core 24. Here again, the projections Ps are identified by serial numbers like the core ridges Rs.

A vertical deflection coil 26 is wound into the shape of a saddle directly on the ferrite core 24 that has the aforementioned arrangements.

In the core slot area, the vertical deflection coil 26 is wound so as to be disposed in the core slots S2 to S9, and S12 to S19, and not in the core slots S1, S10, S11, and S20. Thus, in the core slot area, the vertical deflection coil 26 is wound with a winding angle defined by the core slots S2 to S9, and S12 to S19.

On the external surface of the ferrite core 24 at the vicinity of the wider end, the vertical deflection coil 26 is wound so as to hook around the projections Ps. In other words, as the vertical deflection coil 26 is wound with a winding angle defined by the projection Ps, the winding distribution as desired can be achieved in the smooth area. The positions of the projections Ps are not limited to the ones mentioned above, and it is also acceptable to dispose the projections Ps at arbitrary positions, being irrelevant to the positions of the core ridges. According to this arrangement, it is possible to achieve, in the smooth area, winding distribution that is not restricted so much by the positions of the core slots.

Figure 6:
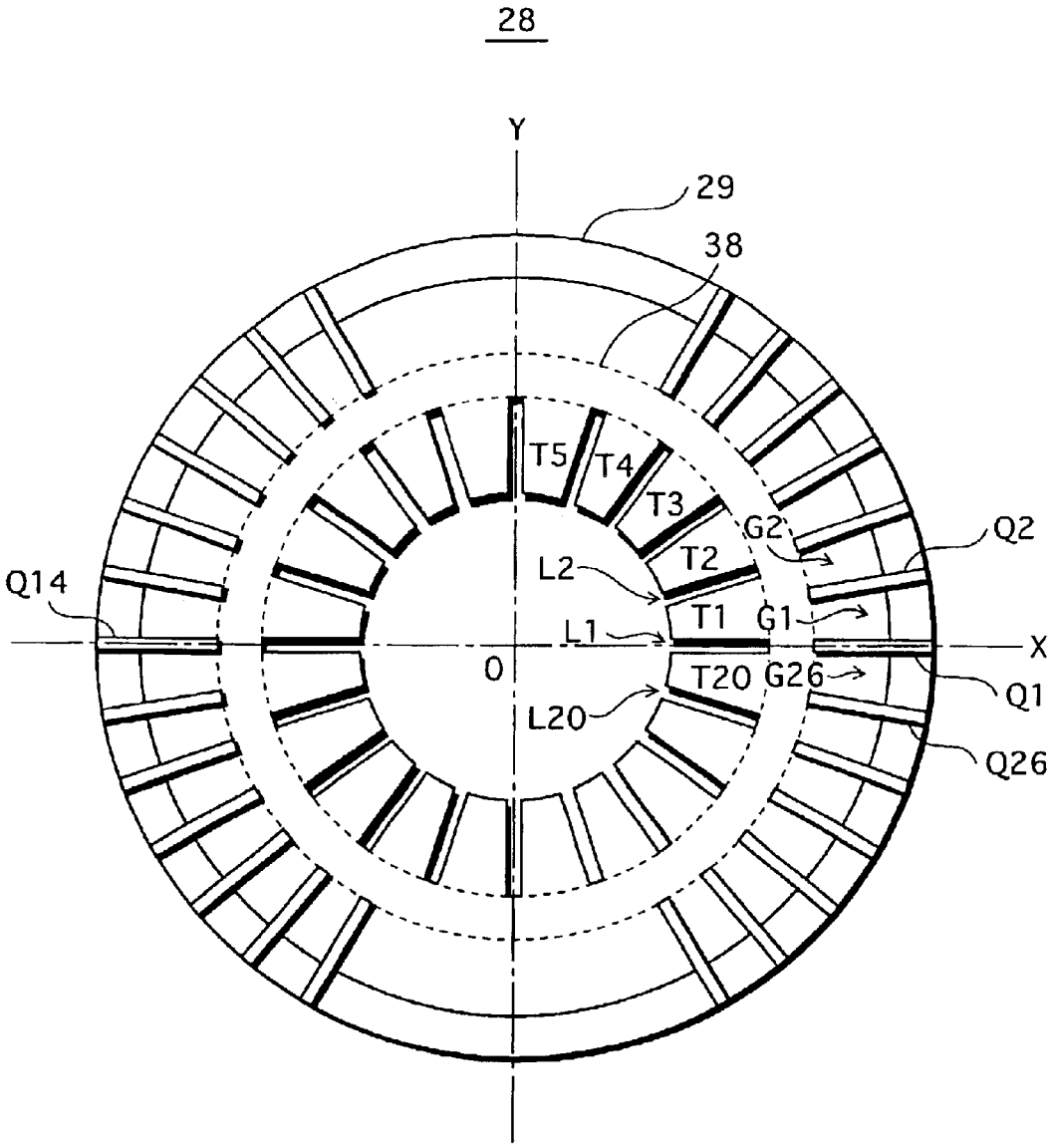
FIG. 6 is a front view of the insulating frame.
Figure 7:
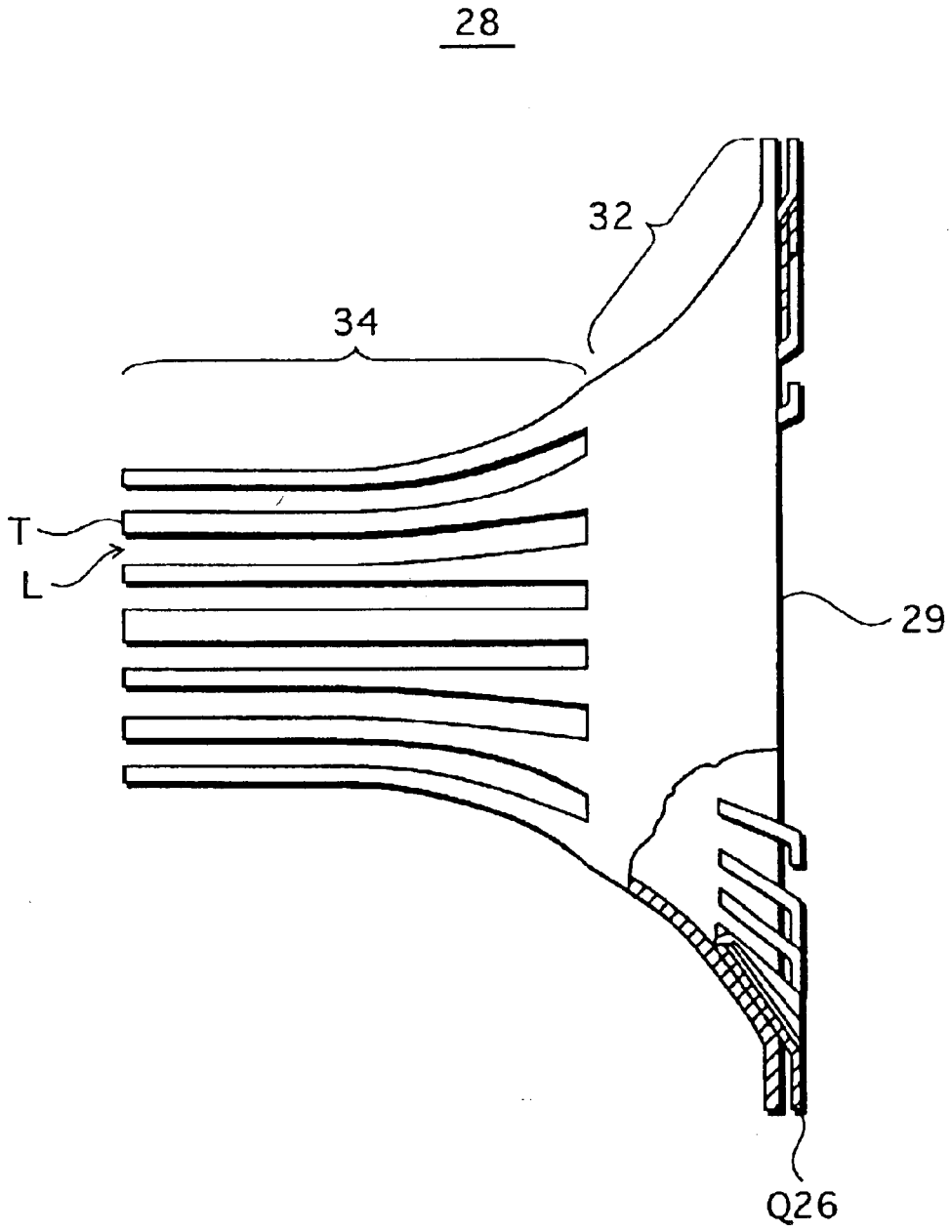
FIG. 7 is a side view of a part of the insulating frame.

FIG. 6 is a partially cut-out front view of the insulating frame 28. FIG. 7 is a plan view of the insulating frame 28.

The insulating frame 28 includes a main body 29 that is substantially in the shape of a truncated cone so as to fit the external shape of the funnel 14, and is made of synthetic resin. The insulating frame 28 electrically insulates the vertical deflection coil 26 from the horizontal deflection coil 30.

The main body 29 is made up of an insulating frame cone 32 that widens toward the phosphor screen side and an insulating frame neck 34 that extends toward the electron gun side.

Formed on the inner wall of the insulating frame cone 32 are a plurality of projections "Qs" (hereafter referred to as guiding projections) each of which extends along the Z axis (the tube axis) direction so as to protrude toward the Z axis, the plurality of guiding projections being arranged circumferentially at predetermined intervals. The guiding projections Qs are curved bars made of synthetic resin that are adhered to the inner wall of the main body 29. As shown in FIGS. 6 and 7, the guiding projections Qs are provided on the wider end side (the end on the phosphor screen side) of the main body 29. As shown in FIG. 6, viewing the insulating frame 28 from the front (from the phosphor screen side) helps you understand that the guiding projections Qs are provided in a radial pattern. As for the guiding projections Qs on the X axis, the guiding projection that is on the right side as we face FIG. 6 will be referred to as Q1, and serial numbers will be given counterclockwise starting from Q1, in order to identify each of the guiding projections as Q1 to Q26. The end of each of the guiding projections Q1 to Q26 on the phosphor screen side is apart from the inner wall of the main body 29 (the insulating frame cone 32) so as to form a space therebetween. As will be explained later, the horizontal deflection coil 30 is wound so as to hook around each of the parts of the guiding projections Qs that form such spaces.

As a result of the guiding projections Qs being formed as mentioned above, a slot (hereafter referred to as a guiding slot) "G" is formed between the guiding projections Qs adjacent to each other. The guiding slots are formed in an area of the insulating frame 28 that corresponds to the smooth area of the ferrite core 24 and/or in an area that is relatively more on the phosphor screen side. The guiding slot formed by the guiding projection Q1 and the guiding projection Q2 will be referred to as the guiding slot G1, and serial numbers will be given counterclockwise starting from G1, in order to identify each of the guiding slots as G1 to G26.

Provided in the insulating frame neck 34 are a plurality of slits each of which extends along the Z axis (the tube axis) direction, and has a predetermined width and a predetermined length. The width will be determined according to the width of the core ridges Rs in the ferrite core 24. The length will be determined according to the length of the core ridges Rs in the ferrite core 24.

As a result of such slits being provided, the insulating frame cone 32 has a plurality of belt-shaped members protruding. As shown in FIG. 7, with such belt-shaped members protruding, the insulating frame neck 34 looks like it has teeth of a comb. Here, the slits are identified with the letters Ls, and the belt-shaped members are identified with the letters Ts. In addition, as shown in FIG. 6, serial numbers are given in the same manner as mentioned earlier, in order to identify each of the slits and the belt-shaped members.

The insulating frame 28 with the aforementioned arrangements will be attached to the ferrite core 24 (FIG. 5) on which the vertical deflection coil 26 is wound. The procedure of attaching the insulating frame 28 to the ferrite core 24 is done by inserting the insulating frame 28, with its end on the insulating frame neck 34 side first, into the wider end of the ferrite core 24. At this time, the insulating frame 28 and the ferrite core 24 will be attached to each other by relatively being slid in the Z axis (the tube axis) direction, so that the slits L1 to L20 are fitted into the corresponding core ridges R1 to R20 respectively, in other words, so that the belt-shaped members T1 to T20 go into the corresponding core slots S1 to S20 respectively.

After the insulating frame 28 and the ferrite core 24 are attached together, the free ends (the ends on the electron gun side) of the belt-shaped members T1 to T20 of the insulating frame 28 will be linked together. Also, a donut-shaped ring 36 made of synthetic resin will be attached in the vicinity of the linking position in order to provide insulation between the vertical deflection coil 26 and the horizontal deflection coil 30. The linking is done by arching from one free end to another. In addition to the aforementioned effect, the ring 36 also serves to ensure mechanical strength of the ends of the belt-shaped members T1 to T20, as well as to provide dimensional stability. It is acceptable to join the ring with the belt-shaped members T1 to T20 by adhesion; alternatively it is also acceptable to provide male couplings on one of the ring and the belt-shaped members and female couplings on the other of those two, so that the male couplings and the female couplings can be fitted into each other.

After the ring 36 is attached, the horizontal deflection coil 30 will be wound into the shape of a saddle on the insulating frame 28 as shown in FIG. 2.

It is acceptable to provide the guiding projections Qs only in the area where the horizontal deflection coil 30 is wound. FIGS. 2 and 6 illustrate an example in which the projections Qs are not provided in the vicinity of the Y axis. It is also acceptable to provide guiding slots in the main body 29 of the insulating frame 28, instead of guiding projections Qs.

Figure 8:
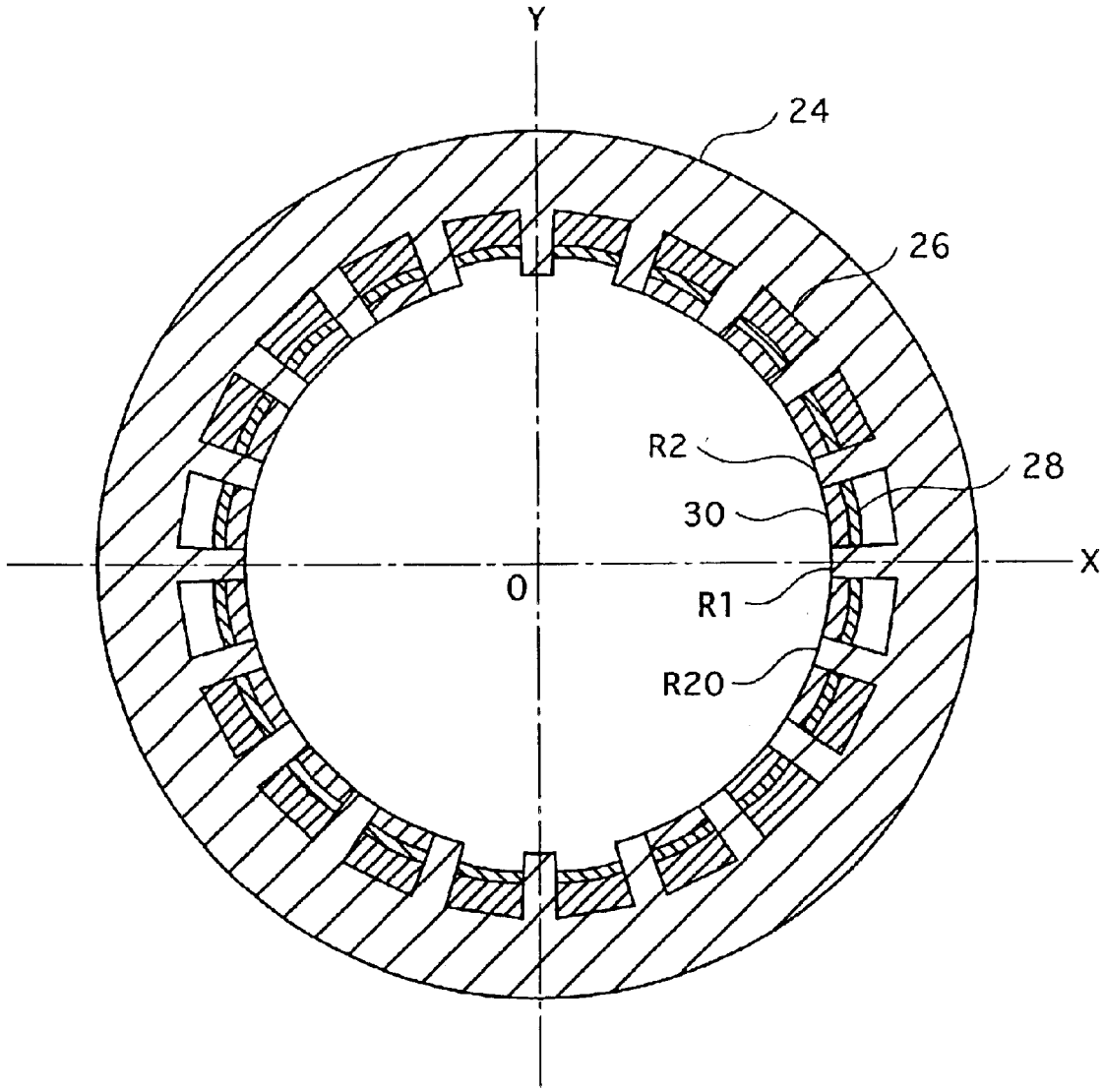
FIG. 8 is a cross section of the deflection yoke, being sectioned at a plane perpendicular to the tube axis of the cathode ray tube.

FIG. 8 shows a cross section of the deflection yoke 20 after the horizontal deflection coil 30 is wound thereon, the deflection yoke being sectioned at a plane perpendicular to the Z axis (the tube axis). The sectioning point of the cross section is positioned, in terms of the Z axis direction, at where the ferrite core 24 has the core slots. In FIG. 8, the sectional view of each of the deflection coils is simply indicated with hatching. As shown in FIG. 8, in the core slot area, the vertical deflection coil 26 and the horizontal deflection coil 30 are wound so as to be guided by the core slots S1 to S20. These two kinds of coils are securely insulated from each other by the belt-shaped members Ts.

In the smooth area of the ferrite core 24, the vertical deflection coil 26 is wound so as to hook around the projections Ps that may be provided irrelevant to the positions of the core slots, as mentioned earlier. Thus, it is possible to achieve flexible winding distribution which is not so much restricted by the pattern of the core slots. Also, in the smooth area of the ferrite core 24, the horizontal deflection coil 30 is wound so as to be guided by the guiding slots Gs that may be provided irrelevant to the positions of the core slots. Thus, it is possible to achieve flexible winding distribution which is not so much restricted by the pattern of the core slots.

In the present embodiment, the guiding slots Gs are arranged at intervals that are different from the intervals at which the core slots Ss are arranged. This way, it is possible to achieve, in the smooth area, flexible winding distribution that is not so much restricted by the core slots Ss.

Additionally, in the present embodiment, the guiding slots Gs are provided being a predetermined distance apart, in the Z axis direction, from the core slots Ss. Hereafter, the area provided because they are apart from each other, which is indicated with the number 38 in FIG. 2, will be referred to as the "partitioning area". Since FIG. 2 is already crowded, indicating the partitioning area with lines in FIG. 2 will make it more complicated; therefore, the equivalent of the partitioning area 38 is indicated in FIG. 6, which is an area between the two circles, a large one and a small one, drawn with dotted lines. With such an arrangement, even if the core slots Ss and the guiding slots Gs are arranged circumferentially at the same intervals, it is still possible to alter the winding direction of the horizontal deflection coil 30 when it comes to the partitioning area 38. For example, it is possible to wind the horizontal deflection coil from a core slot S, not to a guiding slot G positioned on the line extended from the core slot S, but rather to another guiding slot positioned next to that guiding slot. Accordingly, it is possible to achieve, in the smooth area, winding distribution that is not restricted by the pattern of the core slots.

Second Embodiment

The second embodiment basically has the same arrangements as the first embodiment except for the structure of the insulating frame. Consequently, explanation on the arrangements in common will be omitted, and the explanation will focus on the insulating frame.

Figure 9:
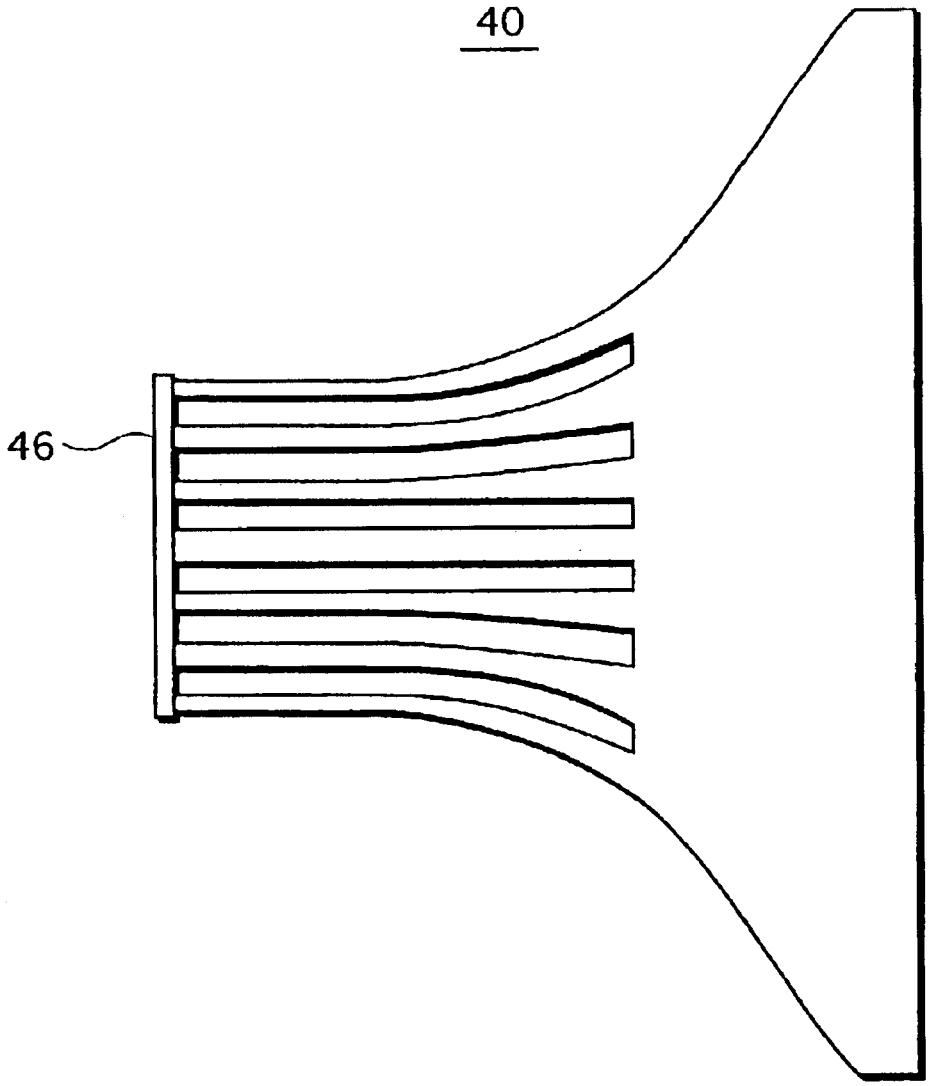
FIG. 9 is a side view of the insulating frame in the deflection yoke of the second embodiment.
Figure 10:
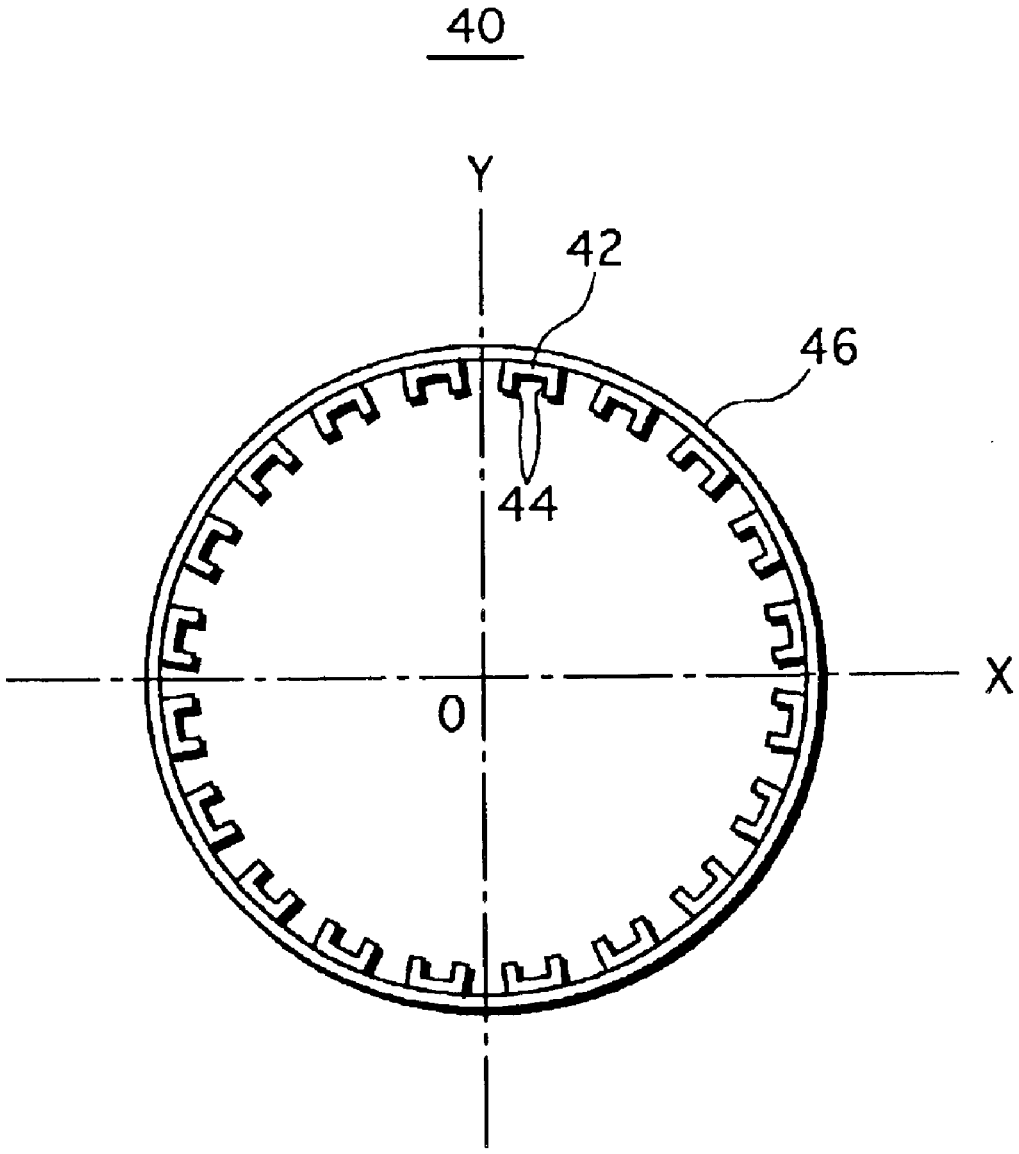
FIG. 10 shows an end of the insulating frame of the second embodiment on the electron gun side, being viewed from the electron gun side.
Figure 11:
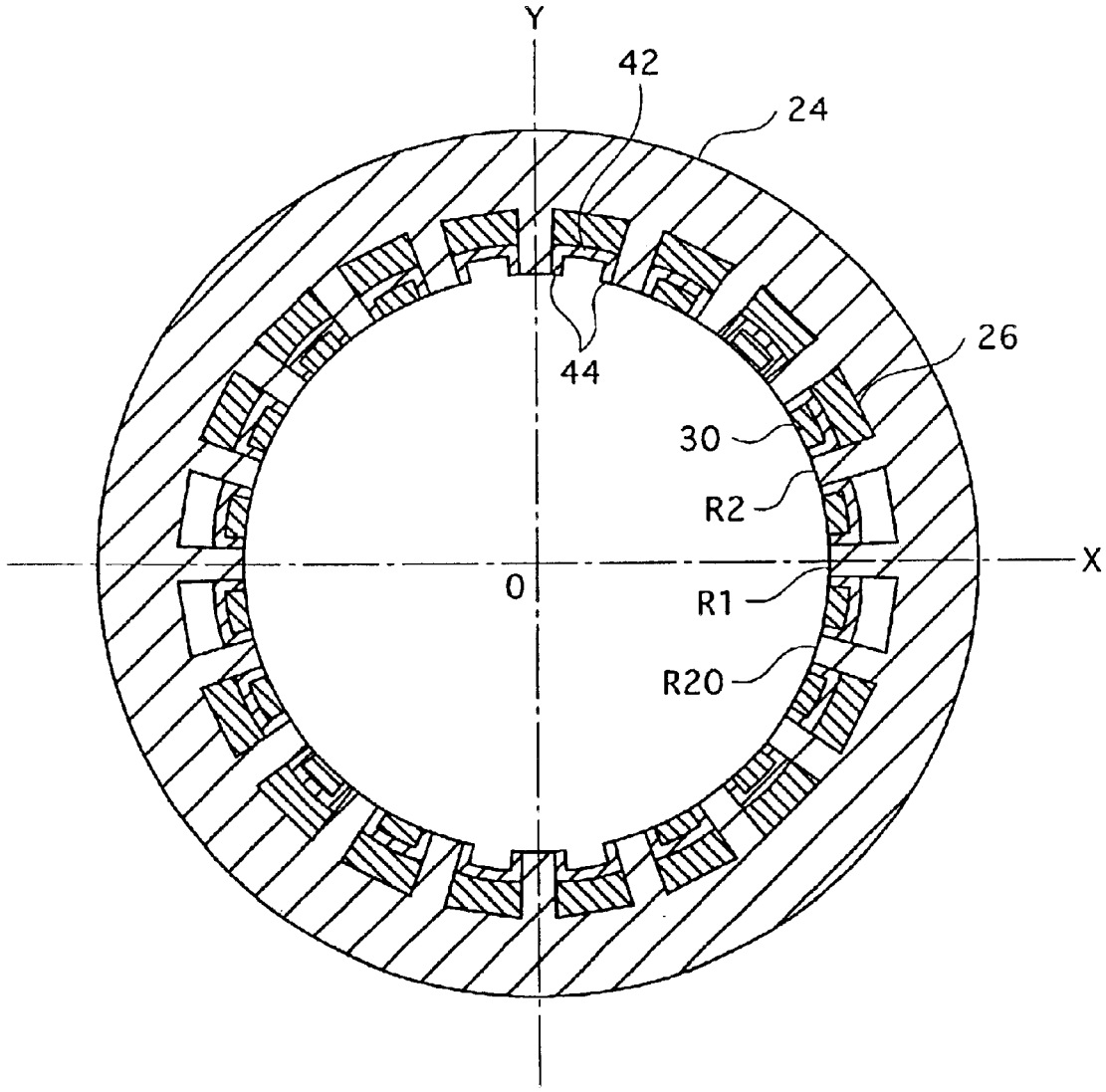
FIG. 11 is a cross section of the deflection yoke of the second embodiment, being sectioned at a plane perpendicular to the tube axis of the cathode ray tube.

FIG. 9 is a side view of the insulating frame 40 of the second embodiment. FIG. 10 shows an end of the insulating frame 40 on the electron gun side, being viewed from the electron gun side. FIG. 11 is a cross section of the deflection yoke of the second embodiment, being sectioned at a plane perpendicular to the tube axis of the Z axis (the tube axis). The sectioning point of the cross section is positioned, in terms of the Z axis direction, at where the ferrite core 24 has the core slots. In FIG. 9, the guiding projections Qs are omitted from the drawing.

The insulating frame 40 is different from the insulating frame 28 in the shape of the cross section of the insulating frame neck. More specifically, it is different in the shape of the cross section of the parts where the vertical deflection coil is insulated from the horizontal deflection coil inside each of the slots (hereafter the parts will be referred to as the "insulating parts inside the core slots").

As shown in FIG. 11, each of the insulating parts inside the core slots 42 has a pair of ribs 44 on the sides and is in the shape of a U. Thus, the insulating parts inside the core slots 42 serve to enhance the mechanical strength as well as to increase the insulation level between the vertical deflection coil 26 and the horizontal deflection coil 30.

The ring 46 is provided in the same manner as in the first embodiment.

Third Embodiment

The third embodiment basically has the same arrangements as the first embodiment except that the structure of the insulating frame is different from the ones in the first and second embodiments. Consequently, explanation on the arrangements in common will be omitted, and the explanation will focus on the insulating frame.

Figure 12:
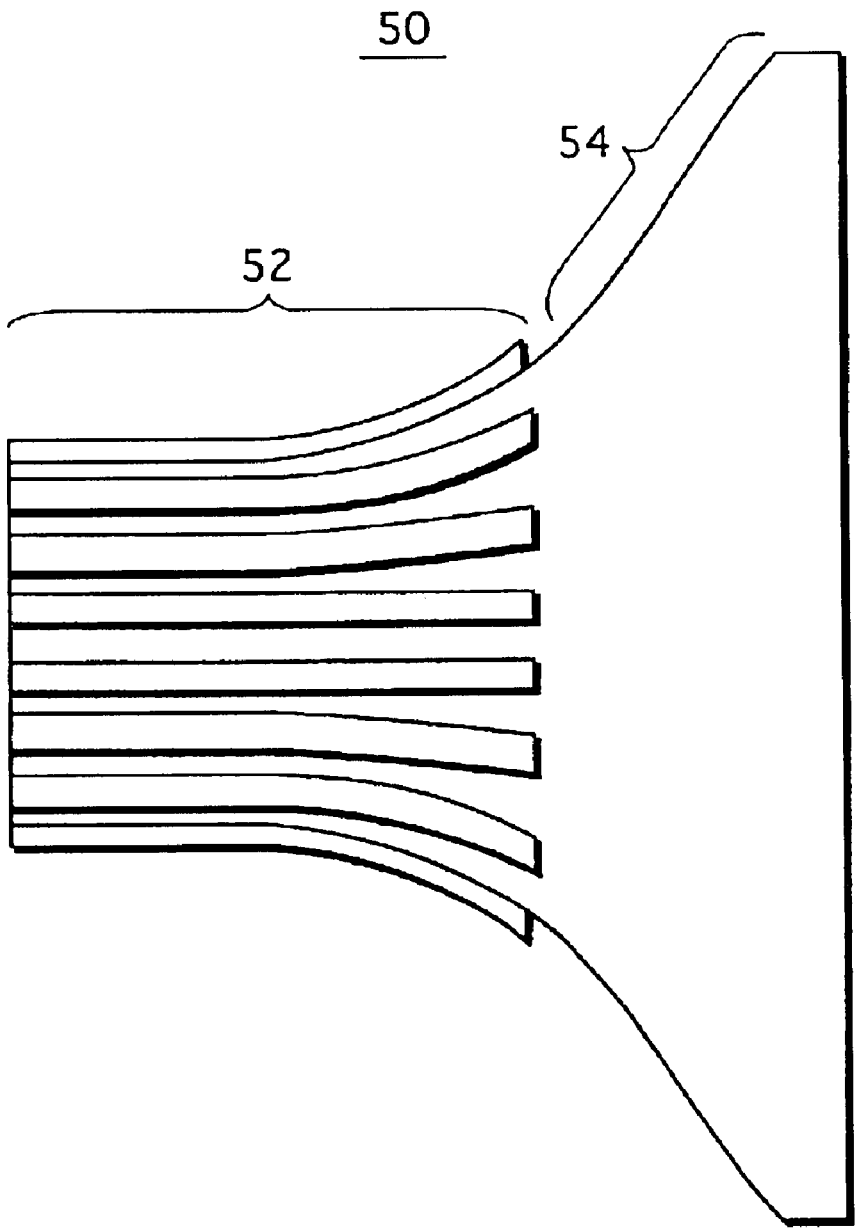
FIG. 12 is a side view of a part of the insulating frame in the deflection yoke of the third embodiment.
Figure 13:
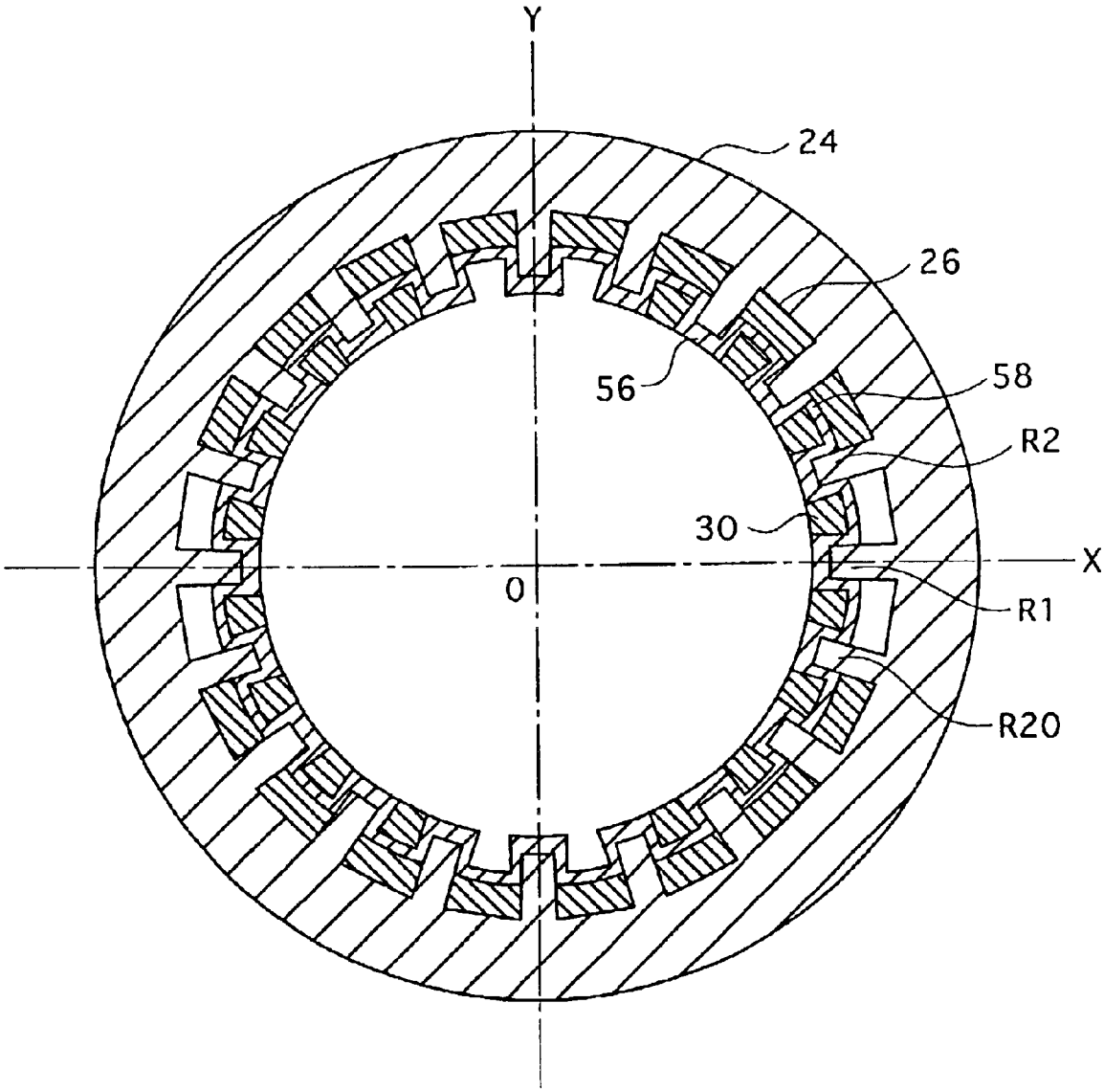
FIG. 13 is a cross section of the deflection yoke of the third embodiment, being sectioned at a plane perpendicular to the tube axis of the cathode ray tube.

FIG. 12 is a side view of the insulating frame 50 of the third embodiment. FIG. 13 is a cross section of the deflection yoke of the third embodiment, being sectioned at a plane perpendicular to the Z axis (the tube axis). The sectioning point of the cross section is positioned, in terms of the Z axis direction, at where the ferrite core 24 has the core slots. In FIG. 12, the guiding projections Qs and the ring are omitted from the drawing.

The insulating frame 50 is different from the insulating frames 28 and 40 in the shape of the cross section of the insulating frame neck. As shown in FIG. 13, slits are not provided in the insulating frame 50, unlike in the insulating frames 28 and 40; the insulating frame 50 therefore is a continuum circumferentially. The insulating frame neck 52 of the insulating frame 50 extends from the insulating frame cone 54, and is formed into a tube with corrugation that fits into the ridges and slots in the core slot area.

The following provides detailed explanation:

The insulating frame 50 has slots 56 (protruding inwardly) and insulating parts 58 (protruding outwardly) that are arranged so as to alternate circumferentially. The slots 56 of the insulating frame 50 fit to the core ridges Rs of the ferrite core 24, respectively. The insulating parts 58 of the insulating frame 50 fit to the core slots Ss, respectively.

There is a space for winding the vertical deflection coil 26 provided between each of the core slots Ss of the ferrite core 24 and each of the insulating parts 58 of the insulating frame 50. There is a space for winding the horizontal deflection coil 30 provided on the internal wall side of each of the insulating parts 58 of the insulating frame 50.

With such arrangements, it is possible to further enhance the mechanical strength of the insulating frame neck as well as to further ensure the insulation between the deflection coils.

The procedure for assembling the deflection yoke is the same as in the first embodiment; it will be therefore partially redundant, but the explanation on the procedure is provided below.

First, the vertical deflection coil 26 is wound so as to be in the core slots Ss of the ferrite core 24. Next, the insulating frame 50 will be inserted into the end of the ferrite core 24 on the phosphor screen side (the wider end). As shown in FIG. 13, the opening width of each of the core slots Ss (in the circumferential direction) is smaller than the width of each of the tips of the insulating parts 58 of the insulating frame 50. Accordingly, the core slots Ss are positioned to fit the positions of the insulating parts 58, and the core slots Ss and the insulating parts 58 are slid against each other to the Z axis direction, so that the insulating parts 58 of the insulating frame 50 are inserted into each of the corresponding core slots Ss, respectively. After the ferrite core 24 and the insulating frame 50 are joined together this way, a ring (not shown in the drawing) will be attached, and the horizontal deflection coil 30 will be wound along the inner wall of the slots of the insulating parts 58.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A deflection yoke provided on an external surface of a cathode ray tube, comprising:

a tube-shaped core (i) in which an opening at a first end is smaller than an opening at a second end, (ii) that is made of a magnetic material, (iii) that has, on an inner wall thereof, a plurality of ridges each of which starts from the first end and extends toward the second end for a part of a length of the core, the plurality of ridges being arranged circumferentially at predetermined intervals and thereby forming a plurality of core slots, and (iv) in which a remaining area of the inner wall thereof in a vicinity of the second end is finished to be smooth;

a first deflection coil that is wound on the core so as to be partially guided by one or more of the core slots;

a second deflection coil that is positioned more inward than the first deflection coil; and an insulating frame that (i) is sandwiched between the first deflection coil and the second deflection coil, and (ii) has, in an area thereof that corresponds to the smoothly-finished remaining area of the core and/or in an area thereof that extends off the second end of the core in a tube axis direction, a plurality of guiding slots extending along the tube axis direction of the cathode ray tube and being arranged circumferentially, wherein the second deflection coil is wound so as to be partially guided by one or more of the guiding slots.

2. The deflection yoke of claim 1, wherein the guiding slots are arranged circumferentially at intervals that are different from the intervals at which the core slots are arranged.

3. The deflection yoke of claim 2, wherein the second deflection coil is wound so that part of its length is disposed in one or more of the core slots, and the insulating frame includes a plurality of insulating members that are belt-shaped so as to extend from the area thereof that corresponds to the smoothly-finished remaining area of the core into each of the core slots.

4. The deflection yoke of claim 3, wherein the insulating frame includes an insulating ring that links ends of the plurality of belt-shaped insulating members.

5. The deflection yoke of claim 2, wherein the second deflection coil is wound so that part of its length is disposed in one or more of the core slots, and the insulating frame includes a plurality of insulating members that extend from the area that corresponds to the smoothly-finished remaining area of the core into each of the core slots, and have cross sections that are shaped to fit cross sections of the core slots.

6. The deflection yoke of claim 2, wherein the insulating frame is, in an area thereof that corresponds to an area of the core having the ridges and the core slots, in a shape of a tube with corrugation so as to fit into the ridges and the core slots in the area of the core.

7. The deflection yoke of claim 1, wherein the second deflection coil is wound so that part of its length is disposed in one or more of the core slots, and the guiding slots are provided being a predetermined distance apart, in the tube axis direction, from the core slots.

8. A cathode ray tube device including a cathode ray tube and a deflection yoke provided on an external surface of the cathode ray tube, the deflection yoke comprising:

a tube-shaped core (i) in which an opening at a first end is smaller than an opening at a second end, (ii) that is made of a magnetic material, (iii) that has, on an inner wall thereof, a plurality of ridges each of which starts from the first end and extends toward the second end for a part of a length of the core, the plurality of ridges being arranged circumferentially at predetermined intervals and thereby forming a plurality of core slots, and (iv) in which a remaining area of the inner wall thereof in a vicinity of the second end is finished to be smooth;

a first deflection coil that is wound on the core so as to be partially guided by one or more of the core slots;

a second deflection coil that is positioned more inward than the first deflection coil; and an insulating frame that (i) is sandwiched between the first deflection coil and the second deflection coil, and (ii) has, in an area thereof that corresponds to the smoothly-finished remaining area of the core and/or in an area thereof that extends off the second end of the core in a tube axis direction, a plurality of guiding slots being arranged circumferentially at intervals that are different from the intervals at which the core slots are arranged, wherein the second deflection coil is wound so as to be partially guided by one or more of the guiding slots.

9. A cathode ray tube device including a cathode ray tube and a deflection yoke provided on an external surface of the cathode ray tube, the deflection yoke comprising:

a tube-shaped core (i) in which an opening at a first end is smaller than an opening at a second end, (ii) that is made of a magnetic material, (iii) that has, on an inner wall thereof, a plurality of ridges each of which starts from the first end and extends toward the second end for a part of a length of the core, the plurality of ridges being arranged circumferentially at predetermined intervals and thereby forming a plurality of core slots, and (iv) in which a remaining area of the inner wall thereof in a vicinity of the second end is finished to be smooth;

a first deflection coil that is wound on the core so as to be partially guided by one or more of the core slots;

a second deflection coil that is positioned more inward than the first deflection coil, and is wound so that part of its length is disposed in one or more of the core slots; and an insulating frame that (i) is sandwiched between the first deflection coil and the second deflection coil, and (ii) has, in an area thereof that corresponds to the smoothly-finished remaining area of the core and/or in an area thereof that extends off the second end of the core in a tube axis direction, a plurality of guiding slots extending along a central axis direction of the core and being arranged circumferentially, wherein the guiding slots are provided being a predetermined distance apart, in the central axis direction, from the core slots, and the second deflection coil is wound so as to be partially guided by one or more of the guiding slots.

* * * * *